US006967629B2

(12) United States Patent
Cuthbert

(10) Patent No.: US 6,967,629 B2
(45) Date of Patent: Nov. 22, 2005

(54) LOW PROFILE ANTENNA

(75) Inventor: David R. Cuthbert, Meridian, ID (US)

(73) Assignee: Micron Technology, Inc., Boise, ID (US)

( * ) Notice: Subject to any disclaimer, the term of this patent is extended or adjusted under 35 U.S.C. 154(b) by 13 days.

(21) Appl. No.: 10/781,806

(22) Filed: Feb. 20, 2004

(65) Prior Publication Data

US 2005/0184917 A1 Aug. 25, 2005

(51) Int. Cl.[7] ..... H01Q 21/00
(52) U.S. Cl. ..... 343/844; 343/803
(58) Field of Search ..... 343/803, 700 MS, 343/793, 806, 844, 846

(56) References Cited

U.S. PATENT DOCUMENTS

| | | | | |
|---|---|---|---|---|
| 4,160,978 A * | 7/1979 | DuHamel | 343/742 |
| 5,654,724 A * | 8/1997 | Chu | 343/742 |
| 5,940,030 A * | 8/1999 | Hampel et al. | 342/372 |
| 6,016,127 A * | 1/2000 | Casciola et al. | 343/731 |
| 6,025,805 A | 2/2000 | Smith et al. | 343/702 |
| 6,236,314 B1 | 5/2001 | Smith et al. | 340/572.7 |
| 6,278,369 B2 | 8/2001 | Smith et al. | 343/700 MS |
| 6,489,925 B2 * | 12/2002 | Thursby et al. | 343/700 MS |
| 6,512,493 B2 | 1/2003 | Park et al. | 343/895 |
| 6,753,816 B1 * | 6/2004 | Apostolos | 343/700 MS |

OTHER PUBLICATIONS

"All-Band Inverted L," L. B. Cebik, http://www.antennex-.com/preview/archive3/ltv.htm, Oct. 20, 2003, 13 pages.

* cited by examiner

*Primary Examiner*—Tan Ho
(74) *Attorney, Agent, or Firm*—Dickstein Shapiro Morin & Oshinsky LLP

(57) ABSTRACT

A low profile antenna having relatively high radiation resistance, wide bandwidth and which utilizes a single conductor and RF source is disclosed. In accordance with an exemplary embodiment, the upper horizontal portion and the lower horizontal portion of the double inverted-L antenna are respectively brought down and up (without being physically connected) at a distance of approximately 180 degrees (½λ) from the RF source so as to form two additional vertical portions of the antenna. This is followed by two approximately 90-degree (¼λ) horizontal conductors portion. The resulting radiation resistance of the low profile antenna is approximately three-times that of a double inverted-L antenna.

23 Claims, 9 Drawing Sheets

LOW PROFILE ANTENNA

FIELD OF THE INVENTION

The present invention relates to the field of radio communications, and more specifically, to a low profile antenna used in the field of radio communications.

BACKGROUND OF THE INVENTION

As circuit size decreases in many mobile communications devices, and associated plastics housings and the like reduce in size, mobile radio handsets are also decreasing in size. One item of a radio communications device which cannot easily be reduced in size, however, is the antenna. Typically the antenna is one half or one quarter of a wavelength in length along at least one axis and as such cannot easily be reduced.

An antenna radiates electromagnetic waves when there is an acceleration of charge through the conductor. This produces a magnetic field, which then produces electromagnetic (EM) radiation. One type of antenna known to those skilled in the art is the resonant dipole antenna 100, depicted at FIG. 1. A radio frequency (RF) source 120 is depicted at the center of the conductor 110 for providing an RF signal resonating at a given frequency (e.g., 5 GHz). The conductor extends out from either end of RF source 120 by ¼ wavelength (¼ λ).

The magnitude of the instantaneous current flowing through the conductor is depicted by the curved line to the right of the antenna. As depicted, the current flow is at a maximum at the center of the conductor 110 and gradually reduces as the ends of the conductor 110 are approached. The circles depict the direction of the magnetic field produced by a current flowing in the upward direction. The magnetic fields for the upper and lower halves of the conductor 110 are depicted as being in the same direction. This signifies that the EM radiation from each half is in phase.

Turning to FIG. 2, the dipole antenna of FIG. 1 is depicted as being bent in half to reduce its vertical profile. The FIG. 2 antenna 200 is known in the art as a double inverted-L antenna. Here, the antenna 200 resonates at the same frequency (e.g., 5 GHz) as the FIG. 1 dipole antenna 100, and the current magnitude remains unchanged from that of the FIG. 1 antenna 100. The main difference between the FIG. 2 antenna 200 and the FIG. 1 antenna 100 is that the magnetic fields produced by the two horizontal portions 220, 230 are now 180-degrees out-of-phase and cancel each other out. As a result, there is virtually no EM radiation from the horizontal portions 220, 230 of the antenna 200; only the vertical portion 210 radiates, thereby greatly reducing the radiation resistance of the antenna 200 from that of the FIG. 1 dipole antenna 100. A reduced radiation resistance translates to the need for a higher antenna current to radiate the same RF energy. Accordingly, there is a need in the field of radio communications for a low profile antenna designed to provide a vertically short profile while exhibiting a relatively high radiation resistance, wide bandwidth, and gain over a simple short conductor.

BRIEF SUMMARY OF THE INVENTION

The shortcomings described above are overcome by the present invention which discloses a low profile antenna having relatively high radiation resistance, wide bandwidth and utilizes a single conductor and RF source. In accordance with an exemplary embodiment of the invention, the upper horizontal portion and the lower horizontal portion of the double inverted-L antenna are respectively brought down and up (without being physically connected) at a distance of approximately 180 degrees (½λ) from the RF source to form two additional vertical portions of the antenna. This is followed by two approximately 90-degree (¼λ) horizontal conductor portions. The resulting radiation resistance of the low profile antenna is approximately three-times that of the double inverted-L antenna.

DETAILED DESCRIPTION OF THE INVENTION

In the following detailed description, reference is made to the accompanying drawings which form a part hereof, and in which is shown by way of illustration specific embodiments in which the invention may be practiced. These embodiments are described in sufficient detail to enable those of ordinary skill in the art to make and use the invention, and it is to be understood that structural and logical changes may be made to the specific embodiments disclosed without departing from the spirit and scope of the present invention.

Figure 3:
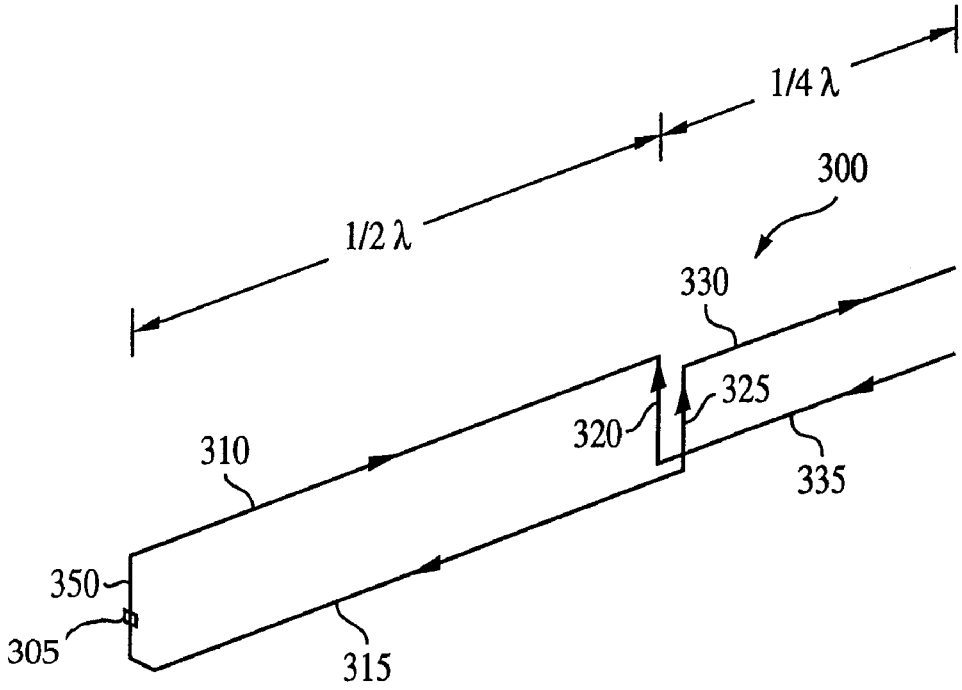
FIG. 3 depicts a low profile antenna, in accordance with an exemplary embodiment if the invention.

FIG. 3 depicts a low profile antenna configuration 300, in accordance with an exemplary embodiment of the invention.

Figure 1:
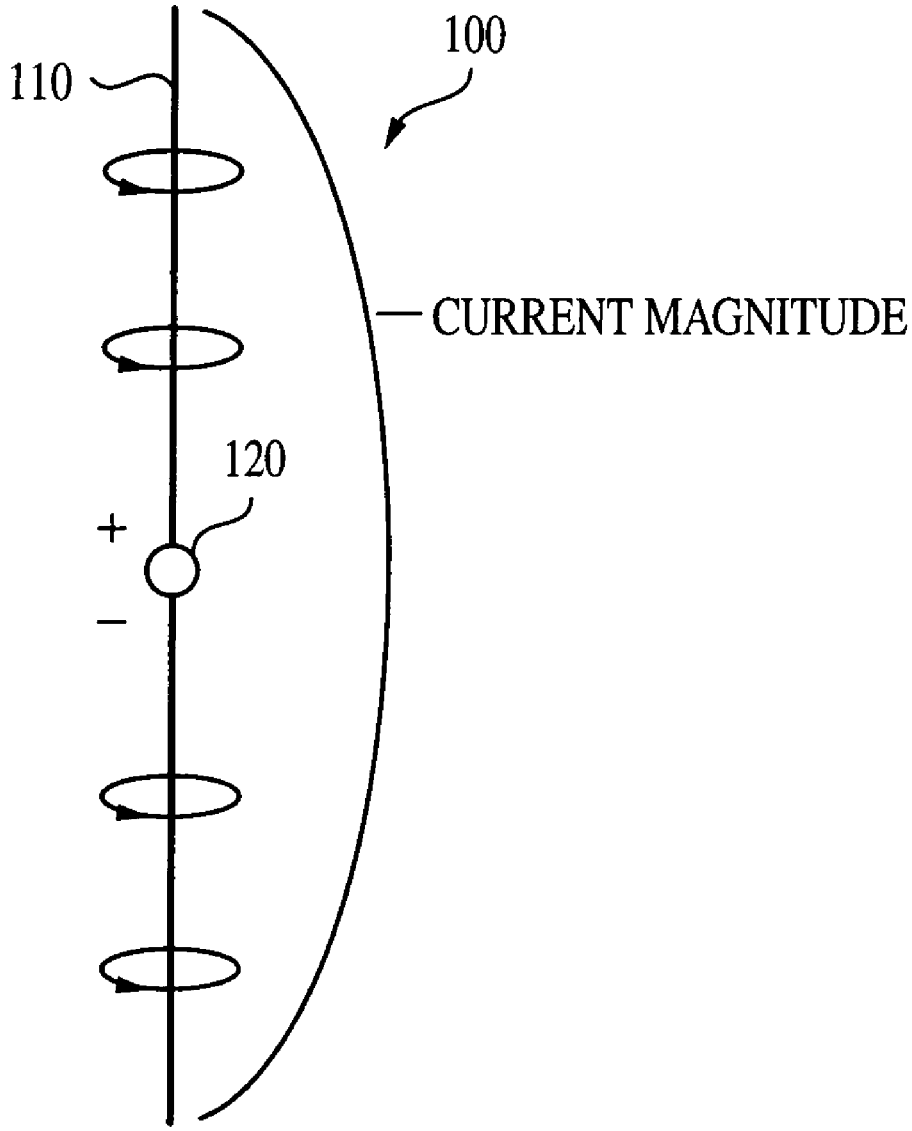
FIG. 1 PRIOR ART
FIG. 1 depicts a configuration of a typical dipole antenna.
Figure 2:
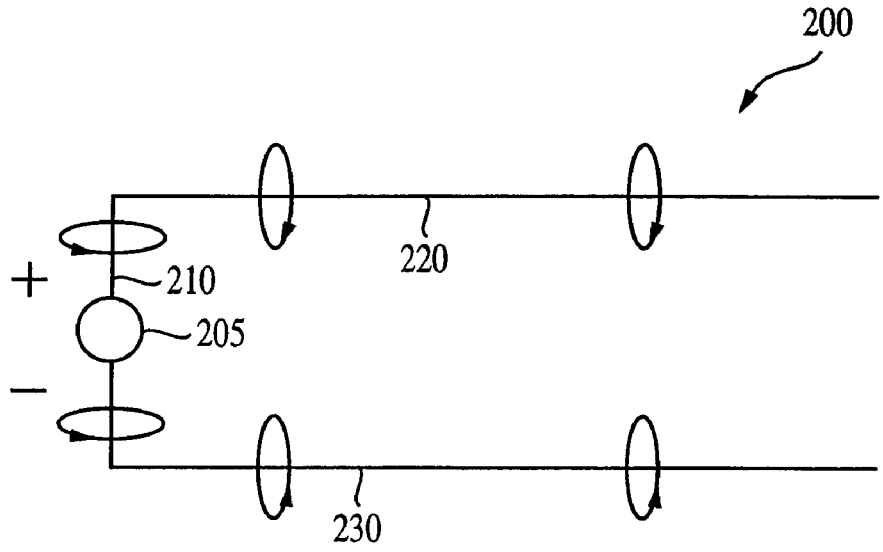
FIG. 2 PRIOR ART
FIG. 2 depicts a configuration of a typical double inverted-L antenna.

The left-hand portion of the antenna 300 is essentially the same as that of the FIG. 2 antenna 200. The antenna 300 has a power source (e.g., an RF source) 305 at the left-most vertical portion 350, and two horizontal portions 310, 315. The antenna 300 also has two vertical portions 320, 325 a distance of 180-degrees (½ λ) from the source 305. The conductors continue for another 90-degrees (¼ λ) beyond the vertical portions 320, 325 as horizontal portions 330, 335.

In accordance with an exemplary embodiment of the invention, the current flow in horizontal portions 310, 315 are in opposite horizontal directions as indicated by the arrows, and therefore, the EM radiation fields of the two lines substantially cancel each other out. Similarly, the current flow in horizontal portions 330, 335 are in opposite directions, as indicated by the arrows, and therefore, the EM radiation fields of those portions are also substantially cancelled out.

The current flow through the vertical portions 320, 325 are in phase, and therefore, they exhibit a resultant EM radiation. Taken together with the EM radiation exhibited by the vertical portion 350 containing the source 305, the aggregate radiation resistance and EM radiation is approximately three-times that of the FIG. 2 antenna 200, which is desirable. It should be noted that the arrows depicting current flow at the vertical portions 320, 325 shift direction due to the fact that the horizontal portions 310, 315 are 180-degree sections, and as a result, the phase of the current changes at the vertical portions of the conductors 320, 325.

Still referring to FIG. 3, the right-hand portion of the antenna 300 contains two horizontal portions 330, 335, each being approximately 90-degrees (i.e., ¼λ) in length. In accordance with the invention, a 90-degree segment of open antenna conductor appears as a short circuit at the feed point (e.g., in the illustrated antenna 300 the feed point is the vertical portions 320, 325) due to the reflection from the open end. The wave launched at the feed point travels 180-degrees from the feed point to the end and back. When the wave arrives back at the feed point, the phase of the generated current has advanced by 180-degrees. Therefore, the outgoing wave and the returning wave are now 180-degrees out-of-phase and the resulting voltage at the feed point is zero. As a result, the vertical portions 350, 320, 325 radiate EM energy, while the horizontal portions 310, 315, 330, 335 resonate the antenna 300 and provide phasing that can be used to build a directive antenna, as described more fully below. The resulting antenna 300 is a low profile antenna having relatively high radiation resistance, wide bandwidth and utilizes a single conductor and RF source 305.

Figure 4:
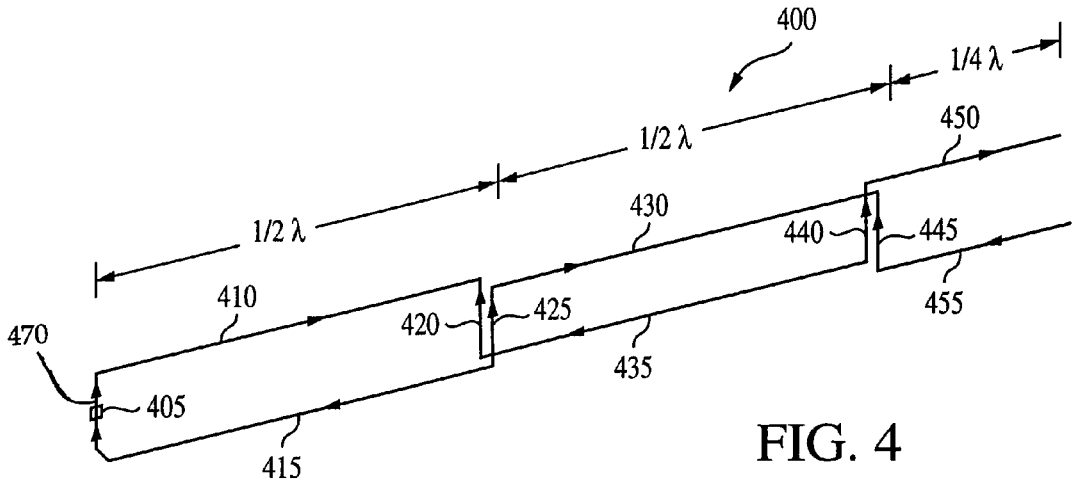
FIG. 4 depicts a low profile antenna, in accordance with another exemplary embodiment of the invention.
Figure 5:
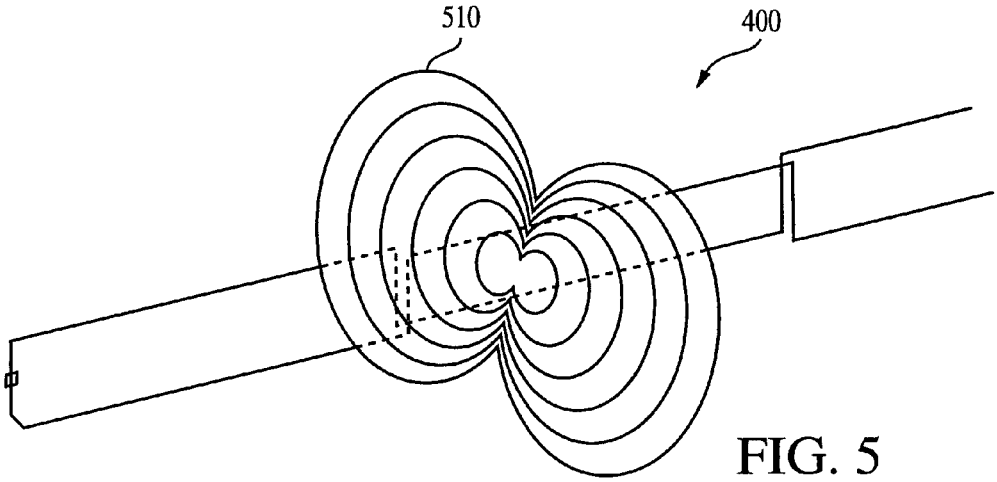
FIG. 5 depicts a radiation pattern for the FIG. 4 low profile antenna, in accordance with an exemplary embodiment of the invention.

Turning to FIG. 4, a low profile antenna 400 is depicted in accordance with another exemplary embodiment of the invention. The antenna 400 has two 180-degree sections made up of horizontal portions 410, 415, 430, 435, and one 90-degree section made up of horizontal portions 450, 455. The antenna 400 also has five vertical portions 470, 420, 425, 440, 445. Similar to the FIG. 3 antenna 300, the horizontal portions 410, 415, 430, 435, 450, 455 of the antenna 400 conduct in opposite directions and therefore, they do not exhibit EM radiation. The vertical portions 470, 420, 425, 440, 445, however, are in phase, and therefore, exhibit EM radiation. In fact, the FIG. 4 antenna configuration 400 exhibits approximately five-times as much EM radiation as the FIG. 3 antenna 300. An exemplary depiction of the EM radiation 510 of the FIG. 4 antenna configuration 400 is shown at FIG. 5.

Figure 6:
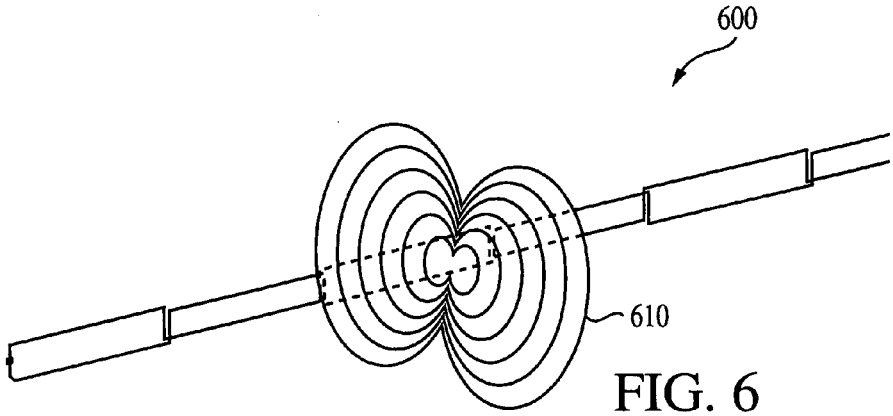
FIG. 6 depicts radiation pattern for another low profile antenna, in accordance with another exemplary embodiment of the invention.

Turning to FIG. 6, an antenna configuration 600 having eleven vertical portions is depicted, in accordance with another exemplary embodiment of the invention. Also depicted is the EM radiation field 610 of the antenna 600. In accordance with the invention, as the number of vertical portions on the low profile antenna is increased, with all but the last horizontal portions being 180-degrees in length, the last horizontal portion being 90-degrees, the directivity of the EM field increases. As compared with the EM field 510 of FIG. 5, the EM field 610 of FIG. 6 is more narrow and can be directed more precisely at a target for more effective communications where such increased directivity is desired.

Figure 7:
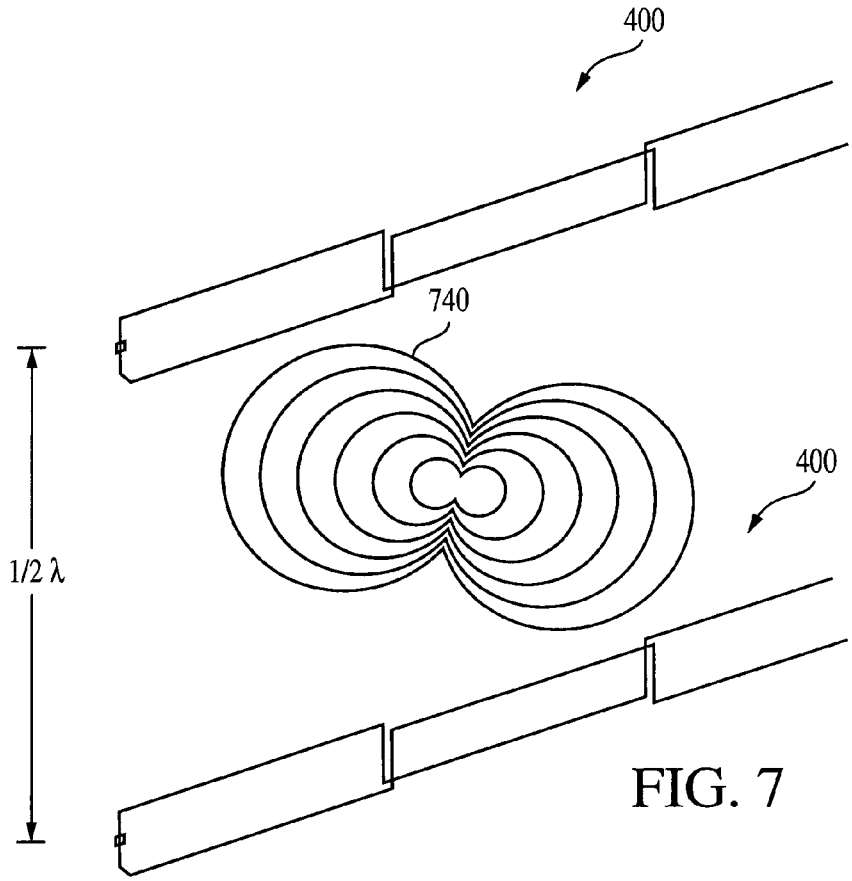
FIG. 7 depicts a low profile antenna configuration, in accordance with another exemplary embodiment of the invention.

Turning to FIG. 7, a low profile antenna configuration is depicted, in accordance with another exemplary embodiment of the invention. In this configuration, two low profile antennas 400 (such as that depicted in FIG. 4) are vertically spaced approximately 180-degrees (½ λ) apart. As depicted here, greater directivity is achieved with a broadside array forming a radiation pattern 740 compressed in the elevation plane.

Figure 8:
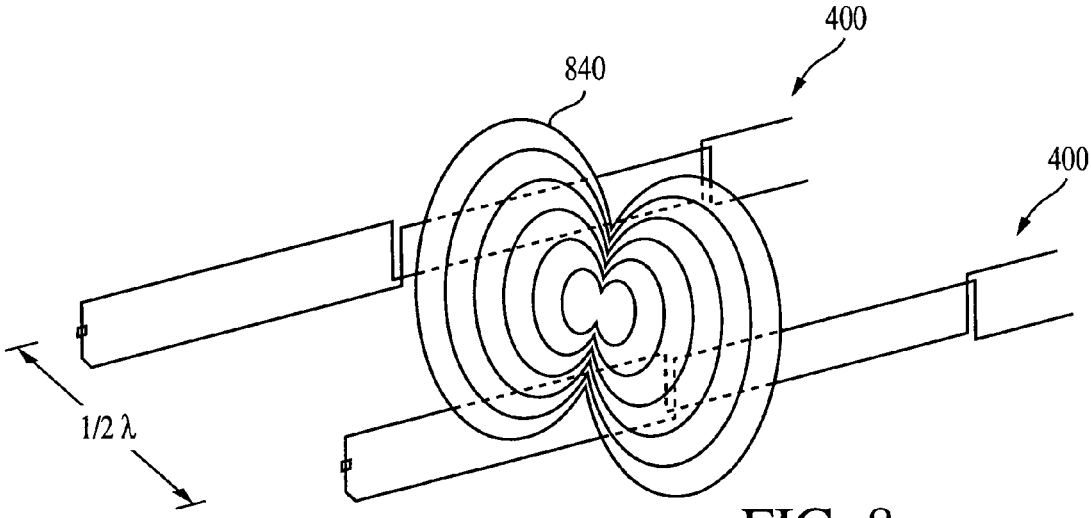
FIG. 8 depicts a low profile antenna configuration, in accordance with another exemplary embodiment of the invention.

FIG. 8 depicts a low profile antenna configuration, in accordance with another exemplary embodiment of the invention. In the illustrated embodiment, two low profile antennas 400 (such as that depicted in FIG. 4) are horizontally spaced approximately 180-degrees (½ λ) apart. Here, greater directivity is achieved with a broadside array in which the radiation pattern 840 is compressed in the azimuth plane.

Figure 9:
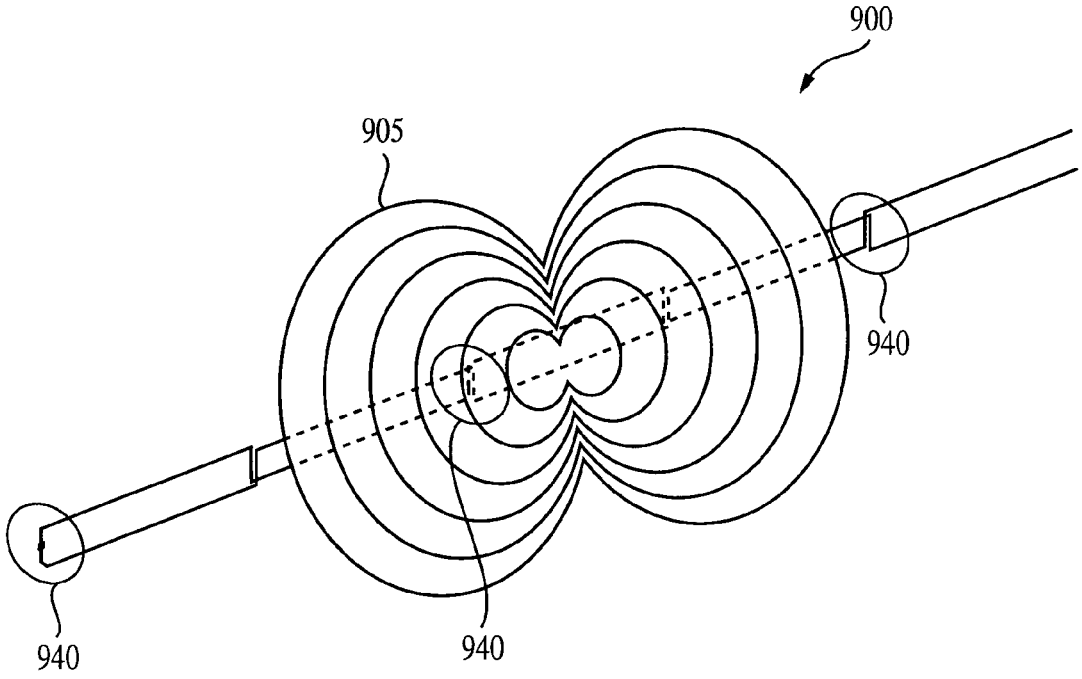
FIG. 9 depicts a low profile antenna configuration, in accordance with another exemplary embodiment of the invention.

FIG. 9 depicts an end-fire low profile antenna configuration 900 in accordance with another exemplary embodiment of the invention. Unlike the configurations previously described, the horizontal portions are each 90-degrees (¼ λ) in length, which means the adjacent vertical portions are separated by 90-degrees. The vertical portions 940 are high current portions which are 180-degrees apart, as in the previously described low profile antennas. There are five such high current portions (circled) out of nine total. The extra current crossing points between the high current portions 940, cause a 180-degree phase reversal, resulting in each high current portion 940 radiating 180-degrees out-of-phase with an adjacent high current portion 940. Radiation is therefore cancelled broadside. However, radiation is additive off the ends and this forms an axially-oriented radiation pattern 905.

Figure 10:
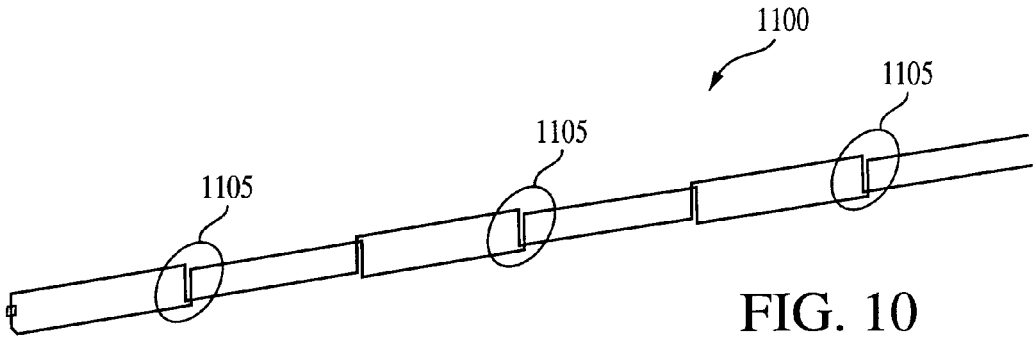
FIG. 10 depicts vertical portions of a low profile antenna configuration with high current flow, in accordance with another exemplary embodiment of the invention.

Turning to FIG. 10, an end-fire low profile antenna configuration 1100 is depicted in accordance with another exemplary embodiment of the invention. The difference between the FIG. 10 configuration 1100 and the FIG. 9 configuration 900 is that the FIG. 10 configuration 1100 has an additional 90-degree horizontal portion. The result of this additional portion is that the feedpoint (i.e., the vertical portion that contains the RF source) is now a minimum current portion rather than a maximum current portion. The vertical portions 1105 (circled) are maximum current portions. The maximum current portions still number five, but are shifted to the right by approximately 90-degrees, as compared with the FIG. 9 antenna 900. One result of this is that the radiation pattern would lie closer to the right-hand portion of the antenna than it does in FIG. 9.

Figure 11:
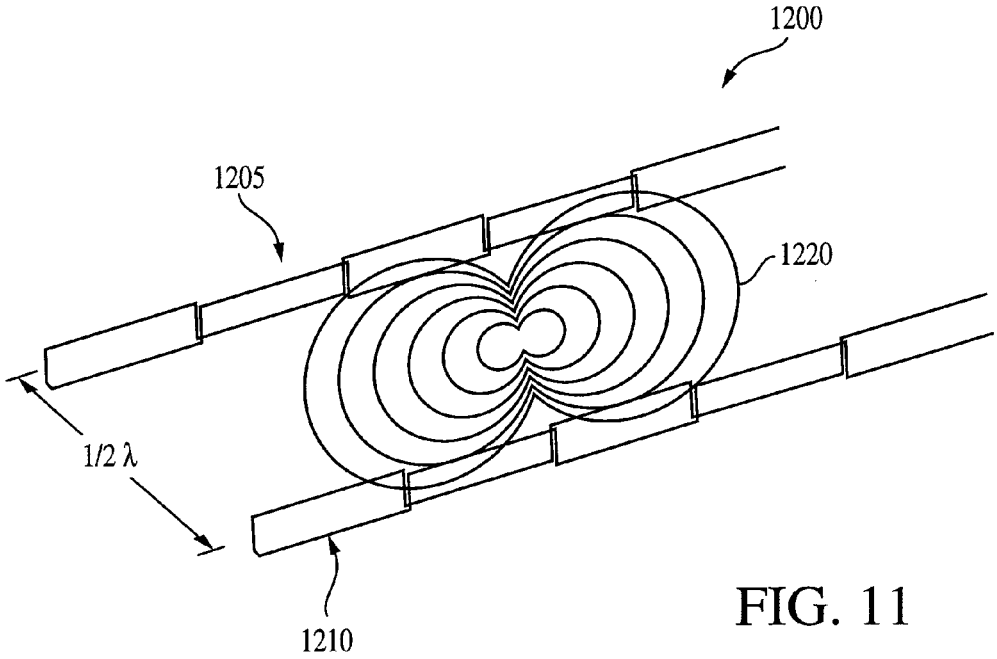
FIG. 11 depicts an end-fire low profile antenna configuration, in accordance with another exemplary embodiment of the invention.

FIG. 11 depicts an end-fire low profile antenna configuration 1200 in accordance with another exemplary embodiment of the invention. In this configuration, two end-fire low profile antennas 1205, 1210 (such as that depicted in FIG. 9)

are fed in-phase and horizontally spaced approximately 180-degrees apart. As a result, the axially-oriented radiation pattern 1220 is compressed in the azimuth plane, as compared with FIG. 9.

Figure 12:
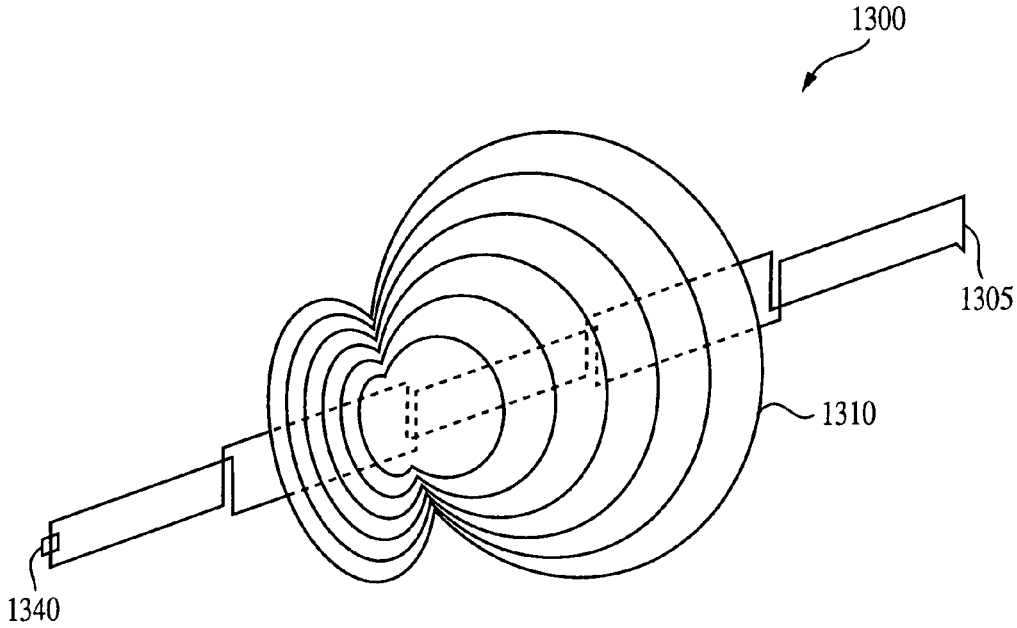
FIG. 12 depicts a unidirectional end-fire low profile antenna configuration, in accordance with another exemplary embodiment of the invention.

FIG. 12 depicts a uni-directional end-fire low profile antenna configuration 1300, in accordance with another exemplary embodiment of the invention. This antenna configuration 1300 is similar to that described in connection with FIG. 9, with the addition of a vertical portion 1305 adjoining the last two horizontal portions, thereby forming a resistive termination. The resulting radiation pattern 1310 is a uni-directional end-fire pattern that radiates largely in the direction opposite the RF source 1340.

Figure 13:
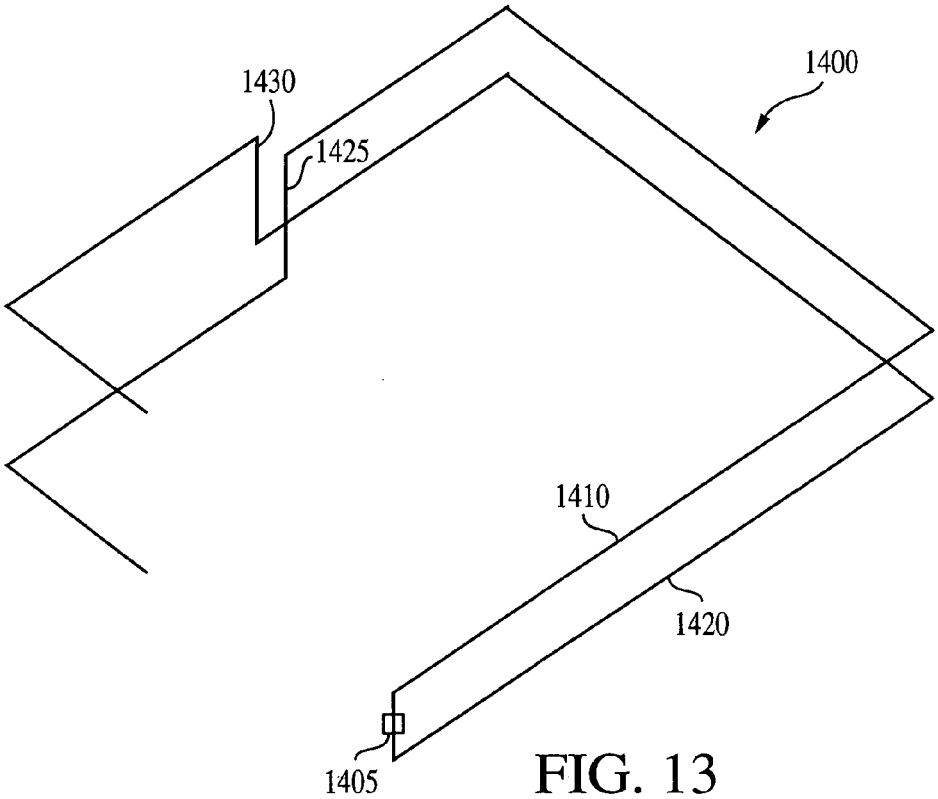
FIG. 13 depicts a folded low profile antenna configuration, in accordance with another exemplary embodiment of the invention.

FIG. 13 depicts a folded low profile antenna configuration 1400 constructed in accordance with another exemplary embodiment of the invention. In addition to having a low vertical profile, antenna 1400 has a reduced horizontal profile, as well. This configuration contains an RF source 1405 at the first vertical portion, which radiates approximately ⅓ the total power. The other approximately ⅔ total power is radiated by the two vertical portions 1425, 1430. In this example, the conductors are vertically spaced approximately 13-degrees apart and the distance from the source 1405 to the end of the antenna 1400 is 270-degrees. This type of antenna 1400 can be built, for example, for the 5 GHz band with a height of approximately 1 mm and a horizontal length per side of approximately 12 mm. In addition, it can be incorporated as part of an IC lead frame.

Figure 14:
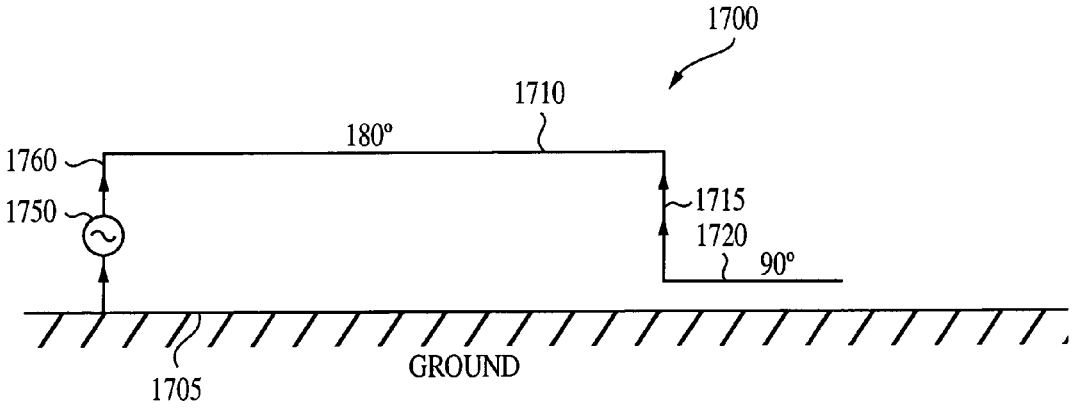
FIG. 14 depicts a grounded low profile antenna, in accordance with another exemplary embodiment of the invention.

FIG. 14 depicts a grounded low profile antenna configuration 1700 in accordance with another exemplary embodiment of the invention. One terminal of RF source 1750 is coupled to ground 1705. The horizontal portion 1710 is approximately 180-degrees in length and, as in previous embodiments, the current flow reverses at the second vertical portion 1715. The vertical portion 1715 is followed by a horizontal portion approximately 90-degrees in length. The FIG. 14 antenna configuration 1700 exhibits approximately two-thirds the EM radiation of the FIG. 3 configuration 300 and does so with a little more than approximately ½ the conductor length.

Figure 15:
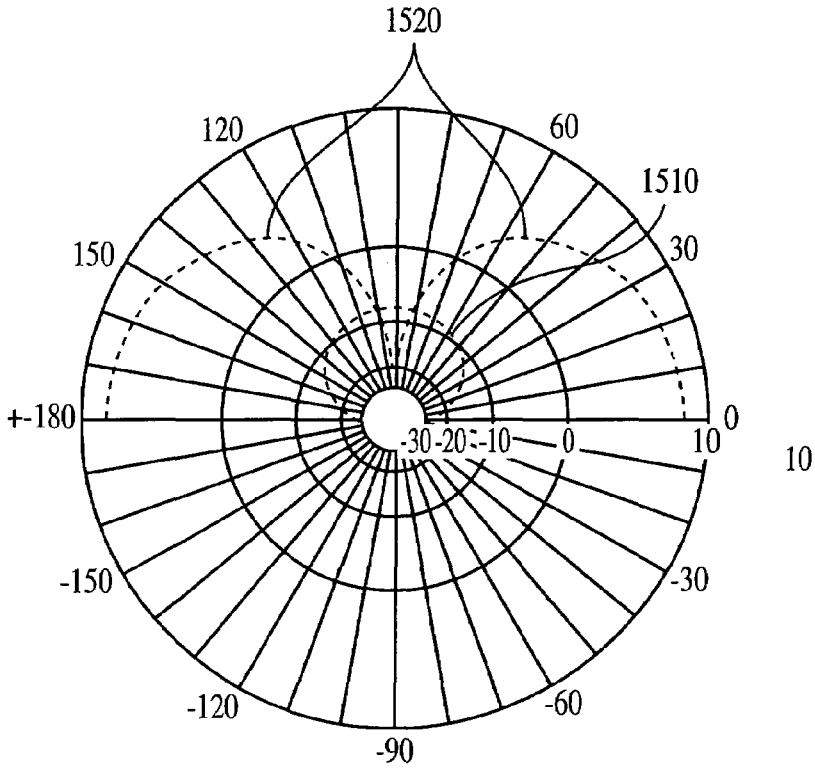
FIG. 15 depicts a broadside view of an exemplary radiation pattern for the FIG. 14 antenna.

FIG. 15 depicts a radiation pattern of the FIG. 14 grounded low profile antenna 1700, in accordance with an exemplary embodiment of the invention. The dotted line pattern 1520 represents the vertical polarization of the EM radiation exhibited by the antenna 1700, and the dashed line pattern 1510 represents the horizontal polarization of the EM radiation exhibited by the antenna 1700.

Figure 16:
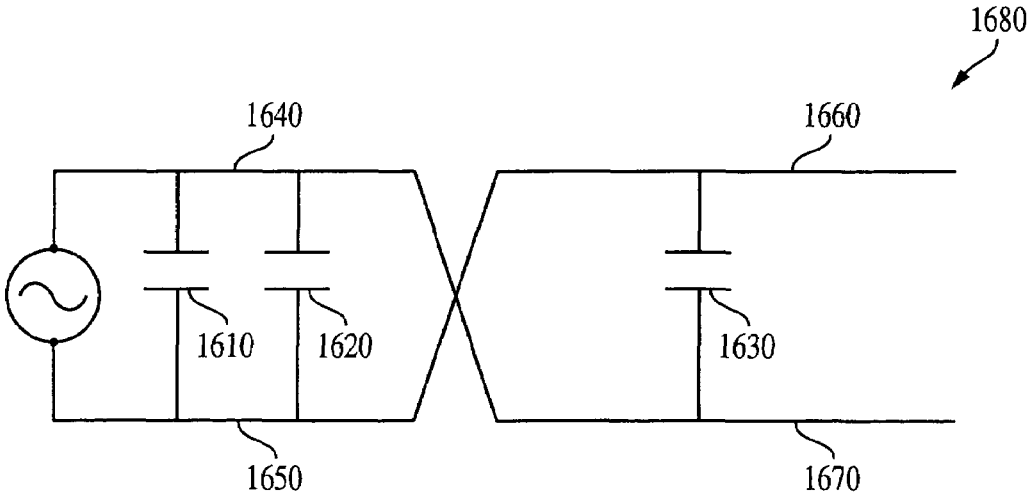
FIG. 16 depicts a dielectrically-loaded cross-current low profile antenna configuration, in accordance with another exemplary embodiment of the invention.

FIG. 16 represents a dielectrically-loaded cross-current low profile antenna configuration 1680, in accordance with an exemplary embodiment of the invention. Coupled between the horizontal portions 1640, 1650, and in parallel with one another, are two capacitive storage nodes (e.g., storage capacitors) 1610, 1620. In addition, a capacitive storage node 1630 is coupled between horizontal portions 1660, 1670. As is known in the art, the inclusion of capacitive nodes coupled between oppositely-phased lengths of horizontal portions (e.g., 1640, 1650) of an antenna conductor, enables the reduction in the length of the horizontal conductor while exhibiting substantially the same phasing and radiation qualities. FIG. 16 depicts the incorporation of such a structure within a low profile antenna configuration 1680, in accordance with an exemplary embodiment of the invention.

As described above, it is desirable to develop a low profile antenna designed to provide a vertically short profile while exhibiting a relatively high radiation resistance, wide bandwidth, and gain over a simple short conductor. Exemplary embodiments of the present invention which accomplish these goals have been described in connection with the figures.

While the invention has been described in detail in connection with preferred embodiments known at the time, it should be readily understood that the invention is not limited to the disclosed embodiments. Rather, the invention can be modified to incorporate any number of variations, alterations, substitutions or equivalent arrangements not heretofore described, but which are commensurate with the spirit and scope of the invention. Accordingly, the invention is not limited by the foregoing description or drawings, but is only limited by the scope of the appended claims.

What is claimed as new and desired to be protected by Letters Patent of the United States is:

1. An antenna configuration, comprising:

at least three portions substantially aligned in a first direction and coupled together by at least a first two portions substantially aligned in a second direction substantially orthogonal to said first direction; and at least a second two portions substantially aligned in said second direction and respectively coupled to at least two of said at least three portions substantially aligned in said first direction, wherein electromagnetic fields to be radiated by said at least a first two portions substantially aligned in said second direction are substantially cancelled out by each other, and wherein electromagnetic fields to be radiated by each of said at least three portions substantially aligned in said first direction are substantially in-phase with each other.

2. The antenna configuration of claim 1, wherein at least one of said at least three portions substantially aligned in said first direction comprises a power source.

3. The antenna configuration of claim 2, wherein said power source comprises a radio-frequency source.

4. The antenna configuration of claim 2, wherein at least two of said at least three portions substantially aligned in said first direction are spaced approximately 180-degrees from said power source.

5. The antenna configuration of claim 2, wherein said at least a first two portions substantially aligned in said second direction are approximately 90-degrees in length; and said at least a second two portions substantially aligned in said second direction are approximately 90-degrees in length.

6. The antenna configuration of claim 5, further comprising an additional portion substantially aligned in said first direction and coupling said at least a second two portions substantially aligned in said second direction, said additional portion being at an opposite end of said antenna configuration from said source.

7. The antenna configuration of claim 1, wherein said at least a second two portions substantially aligned in said second direction are approximately 90-degrees in length.

8. The antenna configuration of claim 7, wherein electromagnetic fields radiated by said at least a second two portions substantially aligned in said second direction are substantially cancelled out by each other.

9. The antenna configuration of claim 1, wherein said at least a second two portions substantially aligned in said second direction are approximately 180-degrees in length.

10. The antenna configuration of claim 9, wherein electromagnetic fields radiated by said at least a second two portions substantially aligned in said second direction are substantially cancelled out by each other.

11. The antenna configuration of claim 1, wherein at least one of said at least a first two portions substantially aligned in said second direction and said at least a second two portions substantially aligned in said second direction are bent in a third direction substantially orthogonal to both said first direction and said second direction.

12. The antenna configuration of claim 1, further comprising at least one capacitive storage node coupled between at least one of said at least a first two portions substantially aligned in said second direction and said at least a second two portions substantially aligned in said second direction.

13. An antenna assembly, comprising:

at least two antenna configurations spaced apart from each other in a first direction, each of said at least two antenna configurations comprising:

at least three portions substantially aligned in a first direction and coupled together by at least a first two portions substantially aligned in a second direction substantially orthogonal to said first direction; and at least a second two portions substantially aligned in said second direction and respectively coupled to at least two of said at least three portions substantially aligned in said first direction, wherein electromagnetic fields to be radiated by said at least a first two portions substantially aligned in said second direction are substantially cancelled out by each other, and wherein electromagnetic fields to be radiated by each of said at least three portions substantially aligned in said first direction are substantially in-phase with each other.

14. The antenna assembly of claim 13, wherein said at least two antenna configurations are spaced apart from each other by approximately 180-degrees.

15. An antenna configuration, comprising:

at least two portions substantially aligned in a first direction and coupled together by a first portion aligned in a second direction substantially orthogonal to said first direction, at least one of said at least two portions substantially aligned in said first direction being coupled to ground; and at least a second portion substantially aligned in said second direction and coupled to at least one of said at least two portions substantially aligned in said first direction, wherein electromagnetic fields to be radiated by each of said at least two portions substantially aligned in said first direction are substantially in-phase with each other.

16. The antenna configuration of claim 15, wherein at least one of said at least two portions substantially aligned in said first direction comprises a power source.

17. The antenna configuration of claim 16, wherein said power source comprises a radio-frequency source.

18. The antenna configuration of claim 16, wherein said first portion substantially aligned in said second direction is approximately 180-degrees in length.

19. The antenna configuration of claim 15, wherein said at least a second portion substantially aligned in said second direction is approximately 90-degrees in length.

20. An antenna, comprising:

a power source provided in a first portion aligned in a first direction;

first and second portions substantially aligned in a second direction substantially orthogonal to said first direction, each having one end connected to a respective end of the first portion aligned in said first direction;

a second portion substantially aligned in said first direction and connected to a second end of the first portion substantially aligned in said second direction;

a third portion substantially aligned in said first direction and connected to a second end of the second portion substantially aligned in said second direction; and third and fourth portions substantially aligned in said second direction, a first end of each being respectively connected to one of said second and third portions substantially aligned in said first direction.

21. The antenna of claim 20, wherein each of said first and second portions substantially aligned in said second direction is approximately 180-degrees in length; and each of said third and fourth portions substantially aligned in said second direction is approximately 90-degrees in length.

22. The antenna of claim 20, wherein each of said first, second, third and fourth portions substantially aligned in said second direction is approximately 90-degrees in length.

23. The antenna of claim 20, further comprising:

fourth and fifth portions substantially aligned in said first direction, a first end of each being respectively coupled to a second end of each of said third and fourth portions substantially aligned in said second direction; and fifth and sixth portions substantially aligned in said second direction, a first end of each being respectively connected to a second end of each one of said fourth and fifth portions substantially aligned in said first direction.

* * * * *